US006653891B1

(12) United States Patent
Hazucha

(10) Patent No.: US 6,653,891 B1
(45) Date of Patent: Nov. 25, 2003

(54) VOLTAGE REGULATION

(75) Inventor: Peter Hazucha, Beaverton, OR (US)

(73) Assignee: Intel Corporation, Santa Carla, CA (US)

( * ) Notice: Subject to any disclaimer, the term of this patent is extended or adjusted under 35 U.S.C. 154(b) by 0 days.

(21) Appl. No.: 10/192,739

(22) Filed: Jul. 9, 2002

(51) Int. Cl.[7] ..... G05F 1/10
(52) U.S. Cl. ..... 327/540
(58) Field of Search ..... 327/534, 535, 327/537, 540, 541

(56) References Cited

U.S. PATENT DOCUMENTS 6,441,680 B1 * 8/2002 Leung et al. ..... 327/541
6,542,024 B1 * 4/2003 Somayajula ..... 327/535
6,552,603 B2 * 4/2003 Ueda ..... 327/541

* cited by examiner

*Primary Examiner*—Jeffrey Zweizig
(74) *Attorney, Agent, or Firm*—Fish & Richardson P.C.

(57) ABSTRACT

A voltage regulator for generating a constant output voltage. The voltage regulator includes an output stage having an internal feedback loop connected to control a current delivered to or received from a load to maintain the output voltage substantially constant relative to an internal reference voltage. The voltage regulator further includes a second feedback loop connected to control the internal reference voltage to cause the output voltage to track an external reference voltage.

33 Claims, 13 Drawing Sheets

VOLTAGE REGULATION

TECHNICAL FIELD

This invention relates to voltage regulation.

BACKGROUND

An integrated circuit chip, such as a microprocessor, often requires multiple supply voltages for different parts of the chip circuit. This may reduce power consumption of components that can utilize a lower voltage than the other portions of the chip. A main supply voltage may be provided to the chip from an off-chip source, and an on-chip power converter may be used to generate additional supply voltages from the main supply voltage. When the main supply voltage from an off-chip source is the highest of the supply voltages used in the chip, a "series voltage regulator" may be used to obtain the other supply voltages that are lower than the main supply voltage.

FIG. 1 shows a conceptual model of a series voltage regulator 10 that includes a controllable series resistor $R_1$ connected between a main power supply (with voltage $V_{IN}$) and an output node 12 (with voltage $V_{OUT}$). For a constant load current $I_{LOAD}$, the value of $R_1$ may be constant. If the load changes over time, a feedback circuit that includes a differential amplifier 14 connected to a reference voltage $V_{REF}$ may be used to dynamically adjust the value of $R_1$ in order to keep the output voltage $V_{OUT}$ substantially constant. The reference voltage $V_{REF}$ may be generated by using a band-gap reference circuit that produces a constant voltage independent of operating temperature and processing conditions. A second resistor $R_2$ may be connected between output node 12 and ground 13 to achieve better control of the output voltage $V_{OUT}$. In a CMOS process, resistors $R_1$ and $R_2$ may be implemented using MOSFET devices.

DETAILED DESCRIPTION

Series Voltage Regulator

Figure 1:
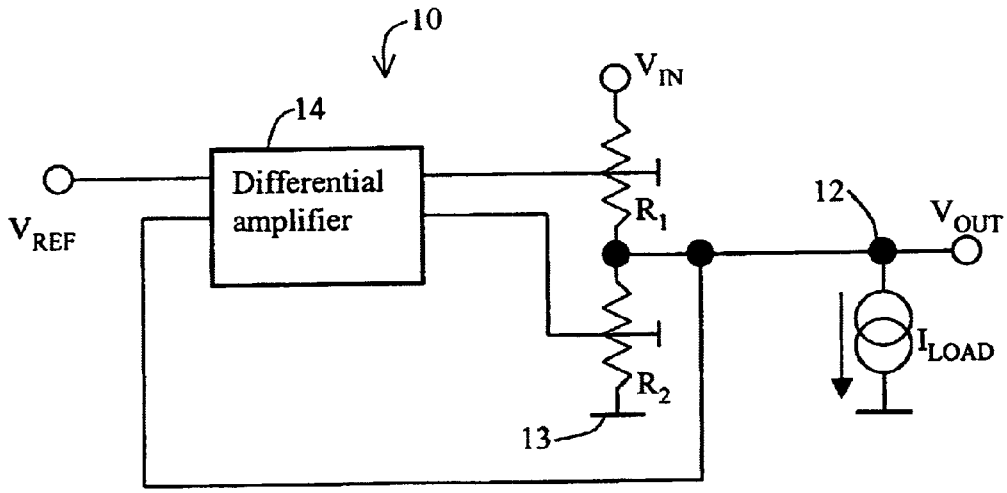
FIG. 1 (Prior art)
FIGS. 1 and 2 show series voltage regulators coupled to load circuits.
Figure 2:
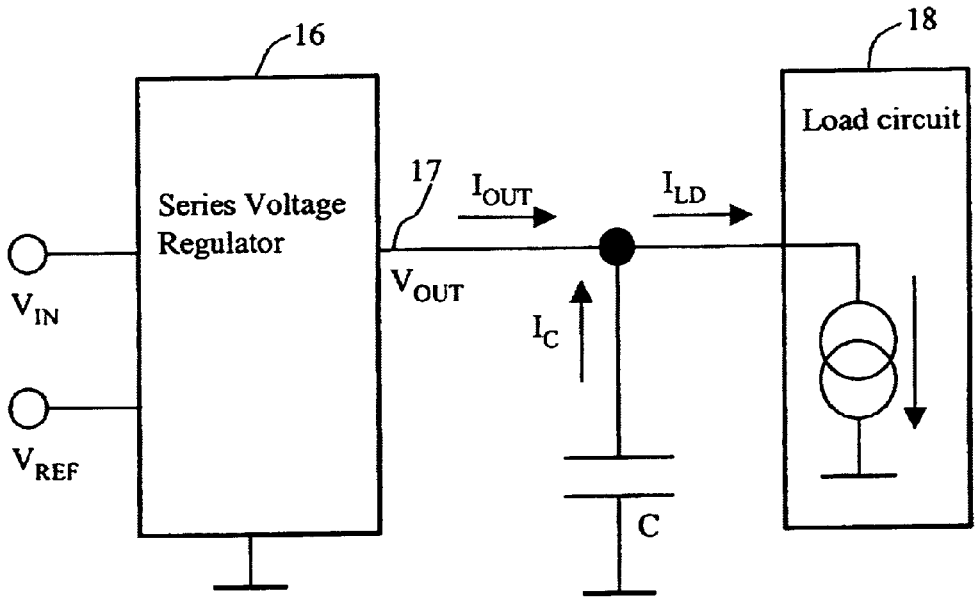
FIG. 2 (Prior art)

FIG. 2 describes a general configuration in which a series voltage regulator 16 is used to provide an output voltage $V_{OUT}$ at a node 17 such that $V_{OUT}$ tracks (is substantially equal to) an external reference voltage $V_{REF}$. Regulator 16 receives an input supply voltage $V_{IN}$ and supplies an output current $I_{OUT}$ to a load circuit 18 that requires a load current $I_{LD}$. When $I_{LD}$ changes, regulator 16 adjusts $I_{OUT}$ so that $V_{OUT}$ remains substantially equal to $V_{REF}$. A decoupling capacitor C is connected to node 17 to provide additional current $I_C$ in case $I_{LD}$ is different from $I_{OUT}$. A goal of regulator 16 is to adjust $I_{OUT}$ sufficiently fast so that $V_{OUT}=V_{REF}$ at all times. If the voltage regulator has a fast response, current $I_C$ will be small and a small capacitor C may be used.

Figure 3:
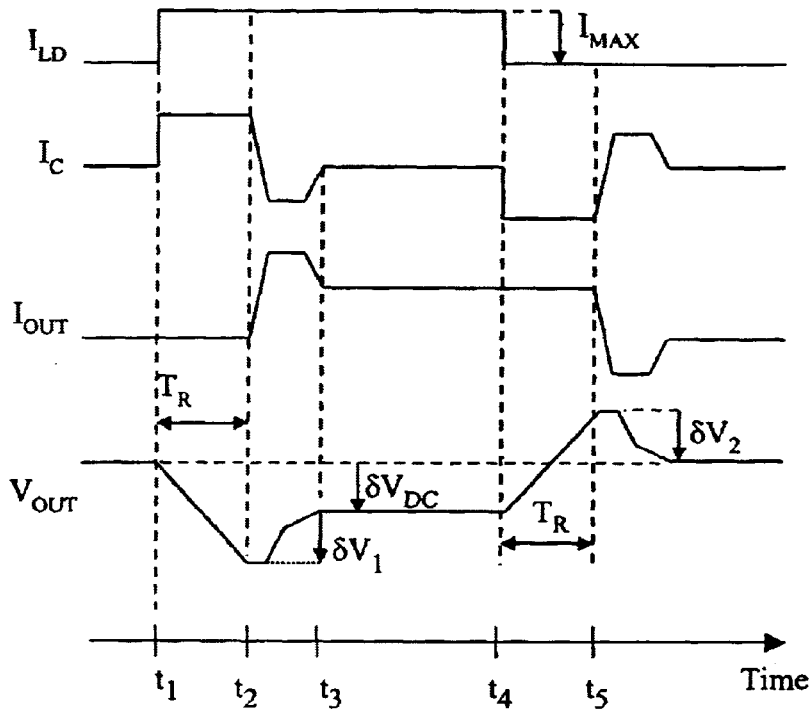
FIG. 3 (Prior art)
FIG. 3 is a timing diagram of a response of a voltage regulator to load current variations.

FIG. 3 describes the operation of regulator 16 under varying load conditions. At time $t_1$, $I_{LD}$ changes from 0 to a maximum current $I_{MAX}$ in a short amount of time. Regulator 16 needs a response time $T_R$ to respond to the new load condition and adjust $I_{OUT}$ accordingly. During time $T_R$, current $I_C=I_{LD}-I_{OUT}$ is supplied from capacitor C, and voltage $V_{OUT}$ drops. After delay $T_R$, at time $t_2$, current $I_{OUT}$ increases and becomes close to $I_{LD}$, and at time $t_3$ $V_{OUT}$ settles to a stable level. The difference in DC levels of $V_{OUT}$ under zero and maximum load current is denoted by $\delta V_{DC}$. At time $t_4$, $I_{LD}$ returns to zero, regulator 16 continues to supply $I_{OUT}$ for an additional time $T_R$. During this time, $V_{OUT}$ rises as capacitor C sinks current $-(I_{LD}-I_{OUT})$. After time $t_5$, voltage $V_{OUT}$ settles to a new DC level corresponding to zero load current. When capacitor C is not sufficiently large to support the sudden load current changes, voltage $V_{OUT}$ exhibits an undershoot $\delta V_1$ and an overshoot $\delta V_2$. The peak-to-peak $V_{OUT}$ variation is equal to $\delta V_{PP}=\delta V_1+\delta V_2+\delta V_{DC}$. In order to minimize $\delta V_{pp}$, the capacitance of the decoupling capacitor has to be larger than $I_{LD}*T_R/\delta V_{DC}$. In that case, $\delta V_{PP}=\delta V_{DC}$. Alternatively, the circuit has to be designed so that the voltage regulator response time $T_R$ is small so that a smaller capacitor is sufficient.

Figure 4:
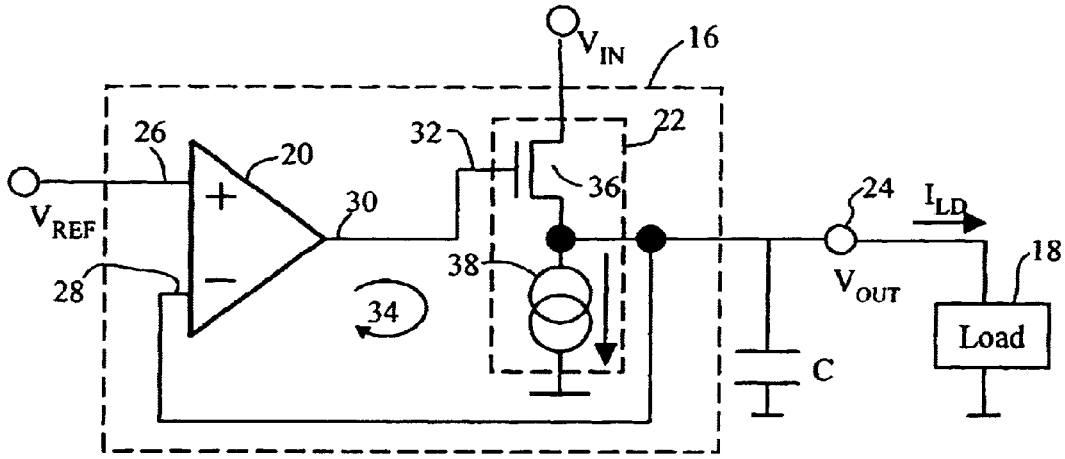
FIG. 4 (Prior art)
FIGS. 4 and 5 show series voltage regulators coupled to load circuits.

FIG. 4 shows a series voltage regulator 16 (enclosed in dashed lines) that includes a differential amplifier 20 connected to a non-inverting output stage 22 (also enclosed in dashed lines). The output stage 22 generates an output voltage $V_{OUT}$ at an output node 24 that is connected to a load 18. The differential amplifier 20 includes a positive input 26 connected to a reference voltage $V_{REF}$ and a negative input 28 connected to the output node 24. Amplifier 20 has an output 30 that drives an input 32 of the output stage 22. By connecting the output node 24 to the negative input 28, a negative feedback loop 34 is created to reduce the difference between $V_{REF}$ and $V_{OUT}$.

Figure 5:
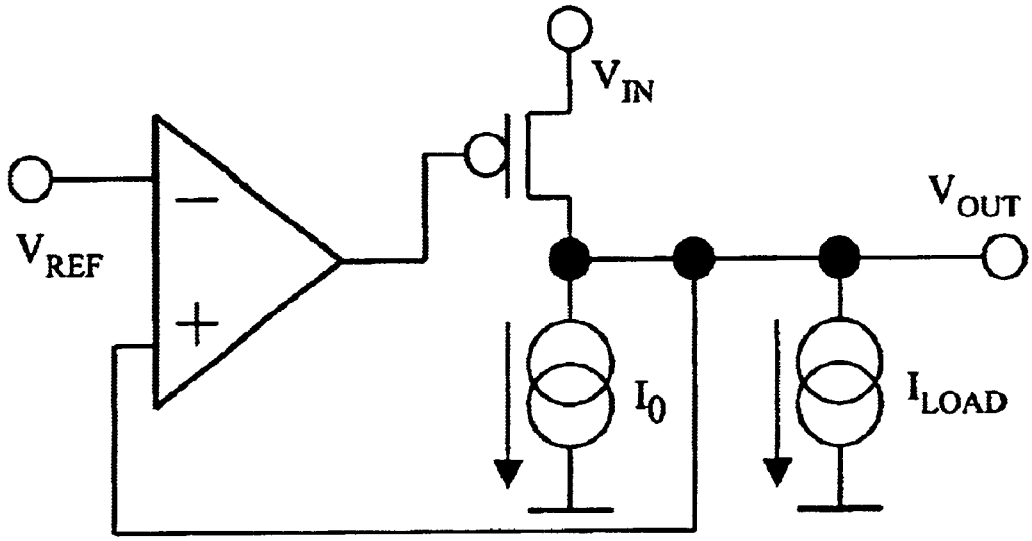
FIG. 5 (Prior art)

An example of the output stage 22 is a source follower that includes an N-channel MOSFET (NMOS) 36 and a current source 38. When load 18 changes rapidly, such as in a digital logic circuit where logic gates switch from one logic state to another, voltage $V_{OUT}$ may temporarily droop or rise if the feedback loop 34 does not respond fast enough. A decoupling capacitor C is connected to the output node 24 to reduce such voltage variations. If an inverting output stage is used, polarity of the amplifier input is reversed, as shown in FIG. 5.

The purpose of the output stage 22 is to provide sufficient output current drive. The purpose of the differential amplifier 20 is to compensate the difference between $V_{OUT}$ and $V_{REF}$(with or without load current) by dynamically adjusting the voltage at output 30, thereby reducing $\delta V_{DC}$. In order that the voltage regulator 16 has a fast response time, it may be necessary to use a fast amplifier 20.

Figure 6:
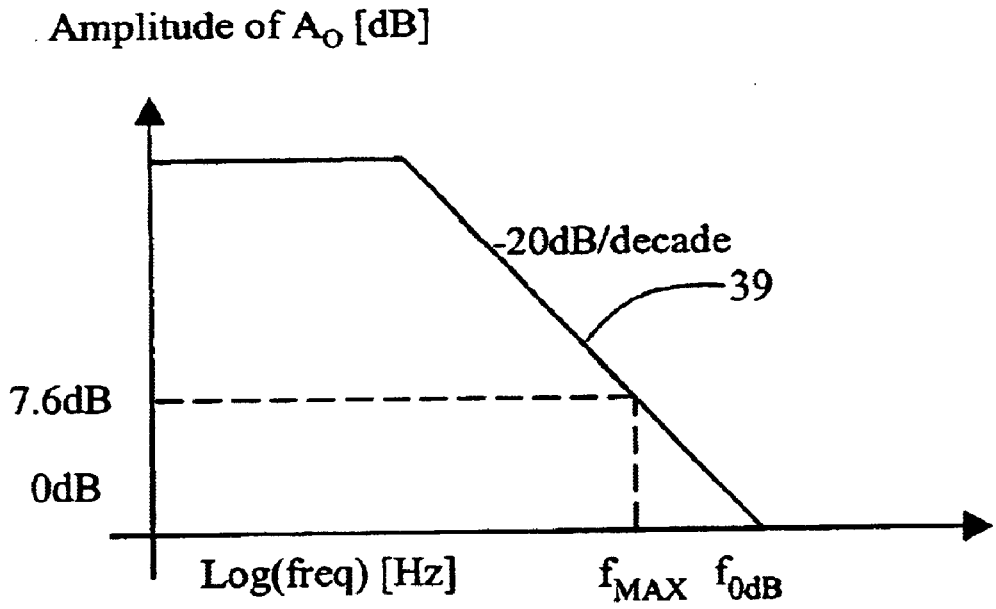
FIG. 6 (Prior art)
FIGS. 6 and 7 are graphs showing open loop gain frequency responses of a voltage regulator.
Figure 7:
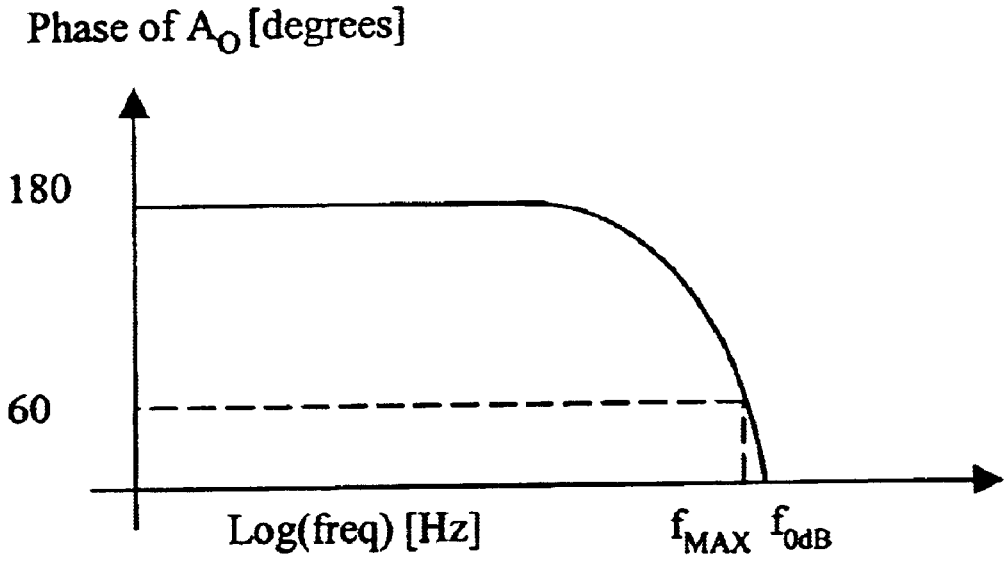
FIG. 7 (Prior art)

FIG. 6 shows the amplitude of the open loop gain $A_O$ of regulator 16 under various operation frequencies. FIG. 7 shows the phase of the open loop gain $A_O$. For simplicity, assume the feedback loop delay is a constant equal to $T_D$. For stability reasons, the phase margin of the open loop gain $A_O$ has to be greater than about 60 degrees at the unity-gain frequency $f_{0dB}$. Under typical operation conditions, the open loop gain $A_O$ will have a first-order response for $f<f_{0dB}$, which gives the amplitude slope 39 of −20 dB/decade. This results in $f_{0dB}=1/(3*T_D)$. The response time of a closed-loop system is approximately $T_R=0.35/f_{MAX}$, where $f_{MAX}$ denotes the −3 dB frequency of the closed-loop gain $A_C$ of regulator 16. Because the closed-loop gain $A_C$ and the open loop gain $A_O$ are related by $A_C=A_O/(1+A_O)$, $f_{MAX}$ corresponds to a frequency where $A_O$=7.6 dB. From FIG. 7, $f_{MAX}=1/(f_{0dB}*A_O)$. The response time of regulator 16 is then approximately $T_R=0.35/f_{MAX}=2.53*T_D$. When amplifier 20 uses several stages to achieve a high gain, large transistors to obtain small offset, and compensation circuitry to achieve sufficient phase margin, the response time of the amplifier 20 as well as the voltage regulator 16 may become slower than variations in the load conditions.

Improved Series Voltage Regulator

By using a low impedance output stage with a fast internal feedback, the output stage may generate an appropriate output current so that the output voltage tracks the internal reference voltage when load conditions change rapidly. Because the output voltage is adjusted by the fast internal feedback of the output stage, it is not necessary to use the differential amplifier to track changes in the load conditions. The differential amplifier only has to adjust the internal reference voltage so that the output voltage does not vary with temperature or manufacturing tolerances. Delay in the feedback loop formed by the differential amplifier and the output stage will have little effect on the ability of the output stage to adjust to load variations.

Figure 8:
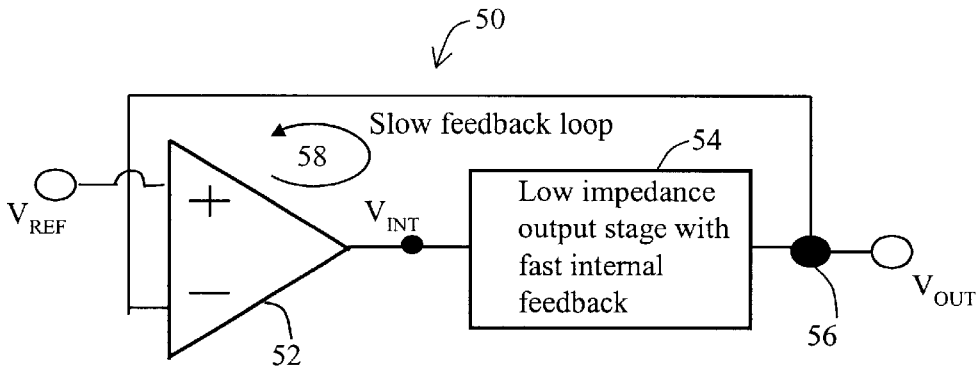
FIGS. 8–11 show series voltage regulators.

FIG. 8 shows a series voltage regulator 50 suitable for use in applications that require large AC current and small DC current, e.g., body bias and generation of analog reference voltage with dominating capacitive load. Regulator 50 includes a differential amplifier 52 connected to a low impedance output stage 54. The output stage 54 receives an internal reference voltage $V_{INT}$ and generates an output voltage $V_{OUT}$ on an output node 56. The output stage 54 has a fast internal feedback loop (described in relation to FIGS. 12–19) that allows the output stage 54 to adjust the output current rapidly in response to rapid load changes. In other words, the output stage 54 adjusts the AC level of $V_{OUT}$ so that $V_{OUT}$ remains substantially constant relative to $V_{INT}$.

The differential amplifier 52 is used to adjust the average level (i.e., the DC level) of $V_{OUT}$ so that it tracks an external reference voltage $V_{REF}$. A positive input of the differential amplifier 52 is connected to $V_{REF}$. A negative input of the differential amplifier 52 is connected to the output node 56, forming a feedback loop 58. The feedback loop 58 causes the differential amplifier 52 to adjust the level of $V_{INT}$ so that the DC level of $V_{OUT}$ is substantially equal to $V_{REF}$. Because the output stage 54 itself has a fast internal feedback loop, the delay in the feedback loop 58 will not degrade the ability of the output stage 54 to adjust the output current so that $V_{OUT}$ remains substantially constant relative to $V_{INT}$. The differential amplifier 52 only has to adjust $V_{INT}$ so that the average level (i.e., the DC component) of $V_{OUT}$ tracks $V_{REF}$. Therefore, the feedback loop 58 may have a slower response without degrading the ability of the voltage regulator 50 to adapt to rapid varying load conditions to provide a constant output voltage.

An advantage of the series voltage regulator 50 is that it may be used in applications with rapidly changing load. Another advantage is that it is possible to use a simple, low-cost differential amplifier having a slower response while still allowing $V_{OUT}$ to accurately track $V_{REF}$ under rapid load variations.

An important difference between regulator 50 and regulator 16 of FIG. 4 is that, in FIG. 4, the feedback loop 34 needs to be as fast as possible so that the output voltage $V_{OUT}$ may track the load current variations. Regulator 16 operates by comparing $V_{OUT}$ with $V_{REF}$ and using amplifier 20 to drive the output stage 22 so that the difference between $V_{OUT}$ and $V_{REF}$ is reduced. In FIG. 8, it is not necessary for the feedback loop 58 to be fast in order to compare $V_{OUT}$ with $V_{REF}$ because the output stage 54 itself has a fast internal feedback loop. It is the internal feedback loop of the output stage 54 that causes $V_{OUT}$ to adjust to load current variations. The feedback loop 58 may be slower since the internal reference voltage $V_{INT}$ only has to be adjusted so that the DC level of $V_{OUT}$ tracks $V_{REF}$.

In applications that require a large AC current as well as a large DC current, it may be necessary to estimate the DC level of $V_{OUT}$ independently of the load current. An "output stage model" may be used to simulate the output stage under zero load conditions so that the internal reference voltage is adjusted to a level such that the output voltage $V_{OUT}$ at a specified constant load current (e.g., zero load current) matches the external reference voltage $V_{REF}$.

Figure 9:
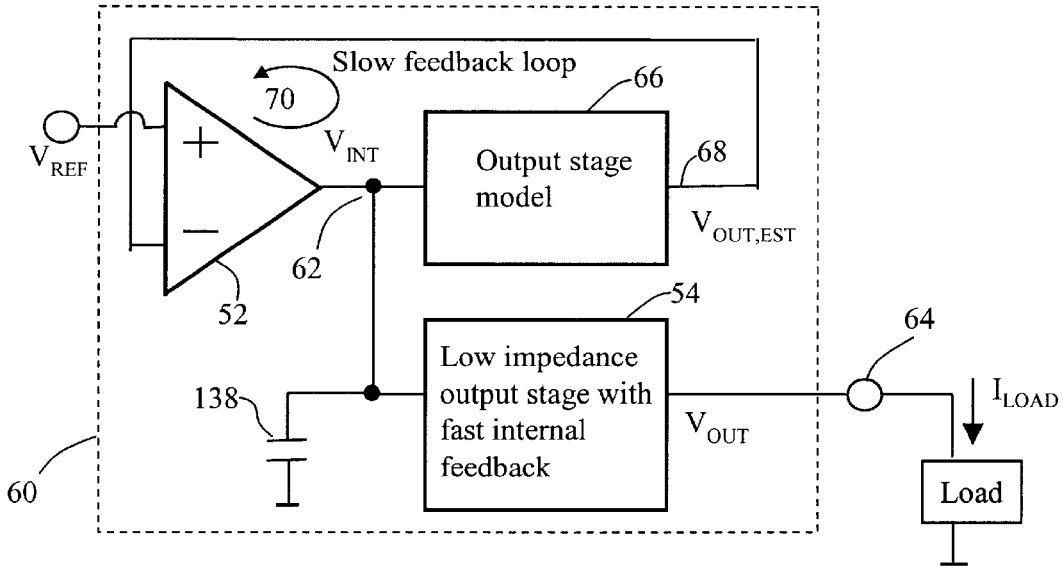

FIG. 9 shows a series voltage regulator 60 that can be used to provide a large AC current as well as a large DC current. Regulator 60 includes a differential amplifier 52 that receives an external reference voltage $V_{REF}$ at a positive input, and generates an internal reference voltage $V_{INT}$ at a node 62. Node 62 is connected to a low impedance output stage 54 which generates an output voltage $V_{OUT}$ and an output current $I_{LOAD}$ at a node 64. The output stage 54 includes an internal fast feedback that adjusts the output current $I_{LOAD}$ in response to load changes so that the output voltage $V_{OUT}$ remains substantially constant relative to $V_{INT}$. In one example, $V_{OUT}$ is not equal to $V_{INT}$, but a constant voltage difference is maintained between $V_{OUT}$ and $V_{INT}$.

A feature of regulator 60 is that the regulator includes an output stage model 66 that simulates the characteristics of the output stage 54 under a specified constant load condition, e.g., zero load condition. The output stage model 66 generates an output voltage $V_{OUT,EST}$ at an output node 68 that is connected to a negative input of differential amplifier 52, forming a feedback loop 70. The feedback loop 70 causes the differential amplifier 52 to adjust $V_{INT}$ so that $V_{OUT,EST}$ is substantially equal to $V_{REF}$. Because the output stage model 66 simulates the characteristics of the output stage 54 with a constant load, $V_{OUT,EST}$ becomes an estimate of $V_{OUT}$ under the constant load. Since $V_{OUT,EST}$ is substantially equal to $V_{REF}$, $V_{OUT}$ will also be substantially equal to $V_{REF}$, as long as the output stage 54 is capable of maintaining $V_{OUT}$ constant under varying load conditions.

An advantage of using the output stage model 66 is that $V_{OUT}$ is decoupled from $V_{INT}$, so that changes in $V_{OUT}$ do not affect $V_{INT}$. $V_{INT}$ maintains a relatively constant level despite changes in load conditions, and will change mainly in response to changes in the environment (e.g., changes in operating temperature). that affect the operating point of the output stage 54. The delay caused by a slow response of the feedback loop 70 will have little effect on $V_{OUT}$. Comparing regulator 60 to regulator 50 (FIG. 8), the use of the output stage model 66 in regulator 60 allows the output stage 54 to supply a substantial DC load current without degrading the transient response of the regulator 60.

Regulator 60 may achieve smaller peak-to-peak output voltage variations than regulator 50 under varying load conditions. As an illustration, suppose that regulator 50 is connected to a load that initially requires zero load current. $V_{OUT}$ will settle to $V_{REF}$. When load current increases to its maximum value, initially $V_{OUT}$ will droop as shown in FIG. 3. The amplifier 52 regulates $V_{OUT}$ so that after some time, $V_{OUT}$ converges to $V_{REF}$. When the load current returns to zero, $V_{OUT}$ will temporarily overshoot $V_{REF}$ before it settles back at $V_{REF}$. Such transient response results in a peak-to-peak variation that is about twice the amount of the initial voltage droop.

Suppose that regulator 60 is initially loaded with zero load current. If the output stage model 66 models the conditions under zero load, then $V_{OUT}=V_{OUT,EST}=V_{REF}$. When the load current suddenly increases to its maximum value, $V_{OUT}$ will droop below $V_{REF}$. $V_{OUT}$ will not converge back to $V_{REF}$ because the feedback loop 70 does not compare $V_{OUT}$ with $V_{REF}$, i.e., feedback loop 70 is not aware of the changes in $V_{OUT}$. If the load current returns to zero, $V_{OUT}$ will return to $V_{REF}$ without overshooting. Therefore, regulator 60 achieves a peak-to-peak variation of $V_{OUT}$ that is only one half of the peak-to-peak variation for regulator 50.

An example of the output stage model 66 is a scaled replica of the output stage 54. For example, the output stage model 66 may be a "scaled-down" version of the output stage 54, i.e., the output stage model 66 has the same circuit configuration as the output stage 54, but the dimensions of the transistors in the output stage model 66 are smaller than those of the output stage 54. This allows the output stage model 66 to simulate the transfer function of the output stage 54 under various processing and temperature conditions while consuming only a small amount of current.

When the load current $I_{LOAD}$ changes, some variation in output voltage $V_{OUT}$ may couple to node 62 through parasitic input-output capacitance. One method of reducing the coupling is to connect node 62 to a decoupling capacitor 138. Another method is to decrease the output impedance of the differential amplifier 52.

Figure 10:
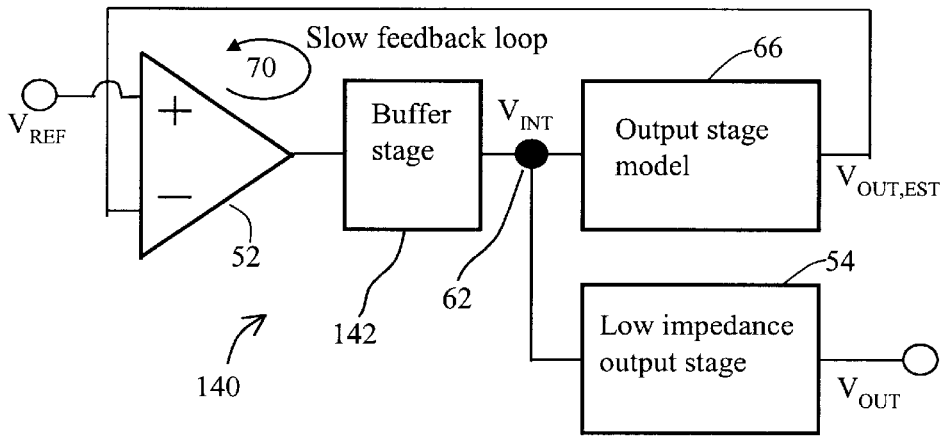

FIG. 10 shows an example of a series voltage regulator 140 that is similar to regulator 60 (FIG. 9), with an additional buffer stage 142 connected between the output of the differential amplifier 52 and node 62. The voltage level at node 62 is used as the internal reference voltage $V_{INT}$. The buffer stage 142 reduces coupling of output voltage variations to node 62 through output stage 54. Using the buffer stage increases delay in the feedback loop 70. Because the design of regulator 140 does not require high bandwidth in the feedback loop 70, cascading the buffer stage 142 and the output stage model 66 does not degrade the transient response of the regulator 140. To further increase accuracy of the internal reference voltage $V_{INT}$, a model of the buffer stage 112 may be used.

Figure 11:
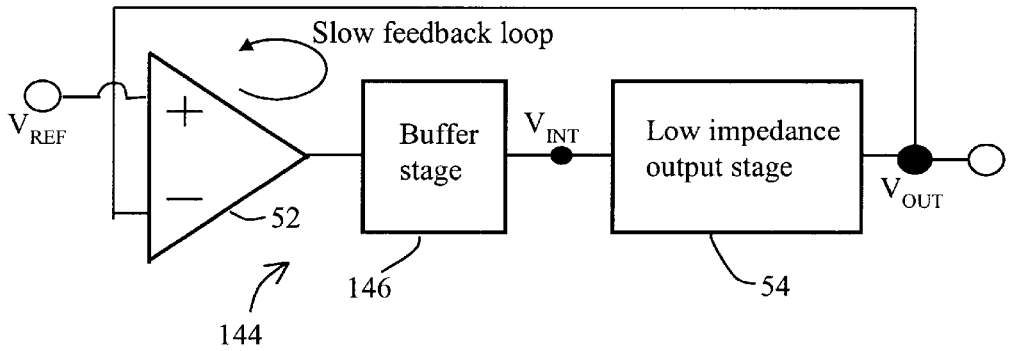

FIG. 11 shows an example of a series voltage regulator 144 that is similar to regulator 50 (FIG. 8), with an additional buffer stage 146 connected between the output of the differential amplifier 52 and the output stage 54. The buffer stage 146 reduces coupling between $V_{OUT}$ and $V_{INT}$ through output stage 54.

Output Stage with Fast Internal Feedback

The following paragraphs describe output stage circuits with fast internal feedback loops that are suitable for use in the series voltage regulators 50, 60, 140, and 144.

Figure 12:
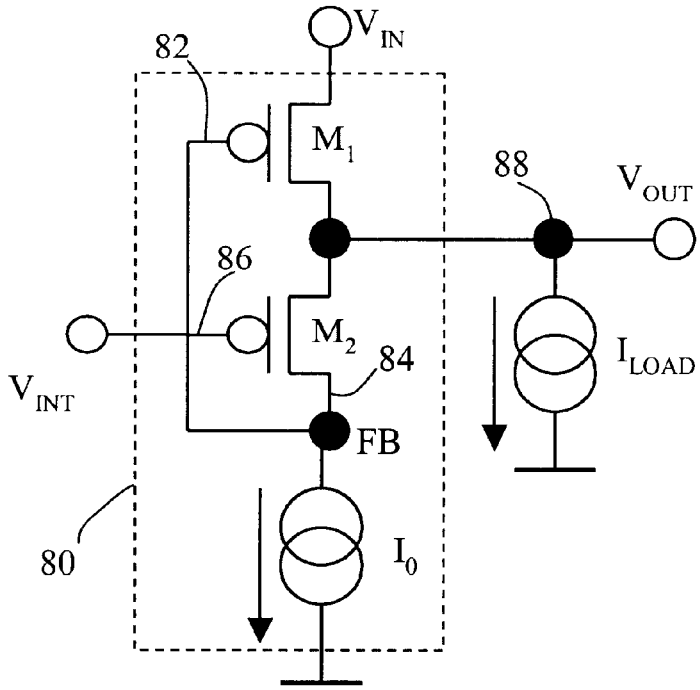
FIGS. 12–19 show output stage circuits.

FIG. 12 shows an example of a low impedance output stage 80 utilizing P-channel MOSFET (PMOS) driving transistors $M_1$ (connected in a common-source configuration) and$M_2$ (connected in a common-gate configuration). A current source $I_0$ sets the quiescent current of the circuit. Gate 82 of $M_1$ is connected to drain 84 of $M_2$, forming a negative feedback loop. Gate 86 of $M_2$ is connected to an internal DC reference voltage $V_{INT}$. The output voltage $V_{OUT}$ is generated at an output node 88.

When operating in a steady state, $V_{OUT}$ settles to a constant value approximately equal to $V_{INT}+V_{T2}$, where $V_{T2}$ is the threshold voltage of transistor $M_2$. If $V_{OUT}$ suddenly drops (e.g., due to an increase in the load current), transistor $M_2$ partially turns off due to a reduced absolute gate-to-source bias, and the voltage on node FB decreases. A lower voltage on node FB turns on transistor $M_1$, which increases the current flowing from output stage 80 to node 88 and counteracts the initial drop on $V_{OUT}$. Because of the common-gate configuration of transistor $M_2$, the voltage gain from node 88 to node FB may be about 20 dB. The actual gain depends on the size of the transistors and the manufacturing process. The output conductance of the output stage 80 is approximately equal to the transconductance of transistor $M_1$ multiplied by the voltage gain from node 88 to node FB.

An advantage of the output stage 80 is that it has a small feedback loop delay $T_D$ that is caused by the delay of a single stage. Therefore, the output impedance is low even at high frequencies greater than 1GHz. Another advantage of the output stage 80 is that due to the small feedback loop delay, the feedback loop remains stable and the circuit does not oscillate. Because the output stage 80 provides a fast response to load changes, $V_{OUT}$ remains substantially constant despite the changes in the load current $I_{LOAD}$. Another advantage is that the output stage 80 may generate an output voltage $V_{OUT}$ that is close to $V_{IN}$ (i.e., $V_{OUT}$ may be higher than $V_{IN}-V_T$).

Figure 13:
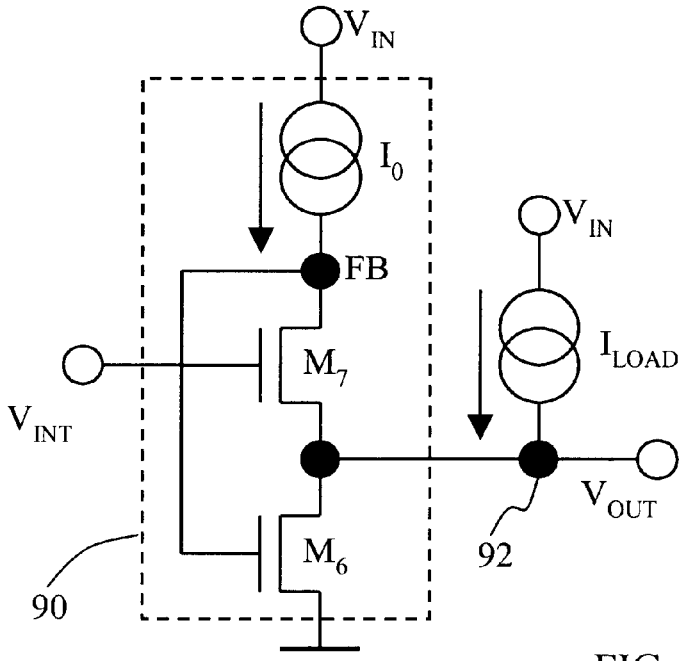

FIG. 13 shows an output stage 90 that is a complementary circuit of the output stage 80. The output stage 90 uses NMOS driving transistors $M_6$ and $M_7$ to generate an output voltage $V_{OUT}$ at node 92. The output stage 90 has a fast transient response and may generate an output voltage $V_{OUT}$ that is close to zero (i.e., $V_{OUT}$ may be lower than $V_T$ if necessary).

Figure 14:
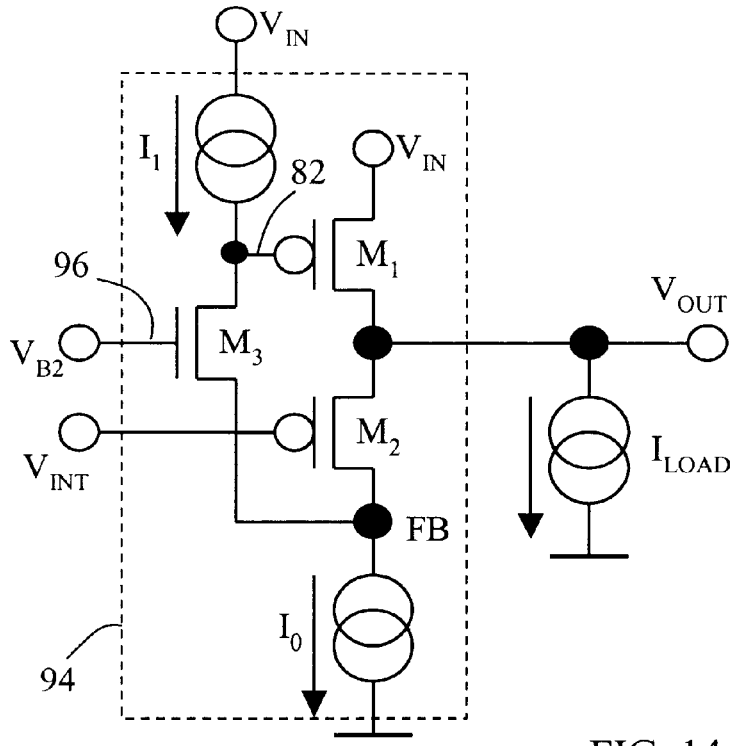

FIG. 14 shows an example of a low impedance output stage 94 that utilizes the circuit of FIG. 12 with an additional NMOS transistor $M_3$ and a current source $I_1$ that function as a level shifter and gain stage. For proper operation, current $I_1$ may be designed to be less than current $I_0$. When node FB rises to be close to $V_{OUT}$, transistor $M_3$ turns off, and the current source $I_1$ pulls up gate 82 of transistor $M_1$. Gate 96 of transistor $M_3$ is connected to a DC bias voltage $V_{B2}$. An advantage of the output stage 94 is that the voltage at node 82 may rise above $V_{OUT}$ and completely turn off $M_1$ under zero load current.

Figure 15:
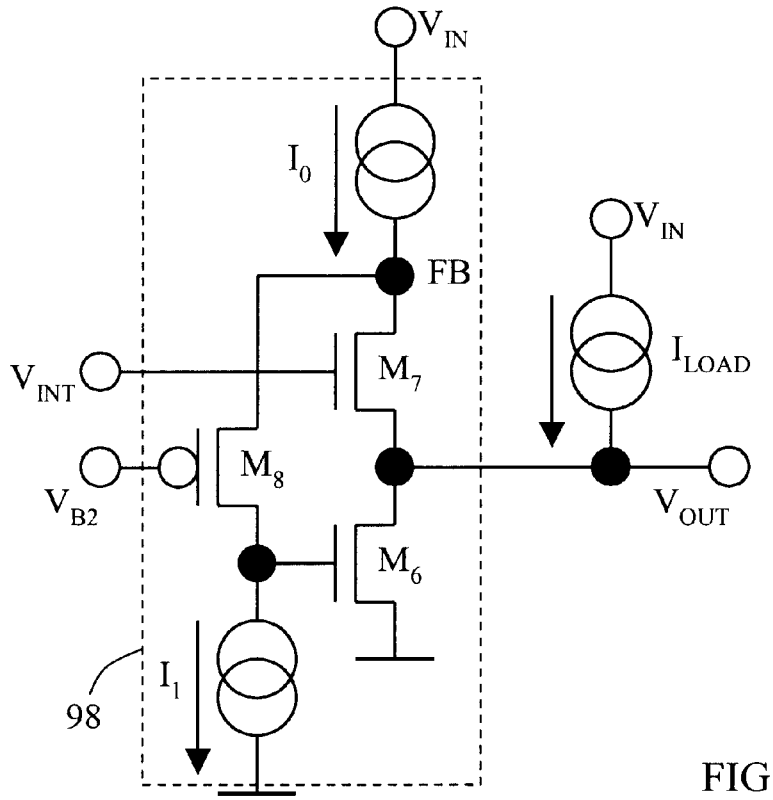

FIG. 15 shows an example of a low impedance output stage 98 that is a complementary circuit of the output stage 94. The output stage 98 is constructed by adding a PMOS transistor $M_8$ and a current source $I_1$ to the circuit in FIG. 13. For proper operation, current $I_1$ may be designed to be less than current $I_0$.

Figure 16:
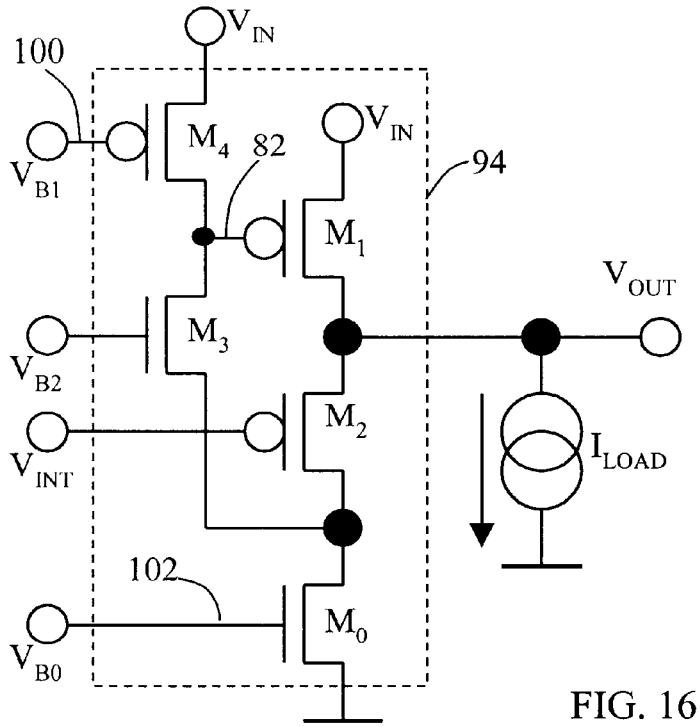

FIG. 16 shows an example of the output stage 94 (FIG. 14) implemented by using a PMOS transistor $M_4$ to function as the current source $I_1$, and an NMOS transistor $M_0$ as the current source $I_0$. Transistors $M_3$ and $M_4$ provide additional feedback gain and voltage level shifting for gate 82 of transistor $M_1$. Gate 100 of transistor $M_4$ is connected to a DC bias voltage $V_{B1}$, and gate 102 of transistor $M_0$ is connected to a bias voltage $V_{B0}$.

Figure 17:
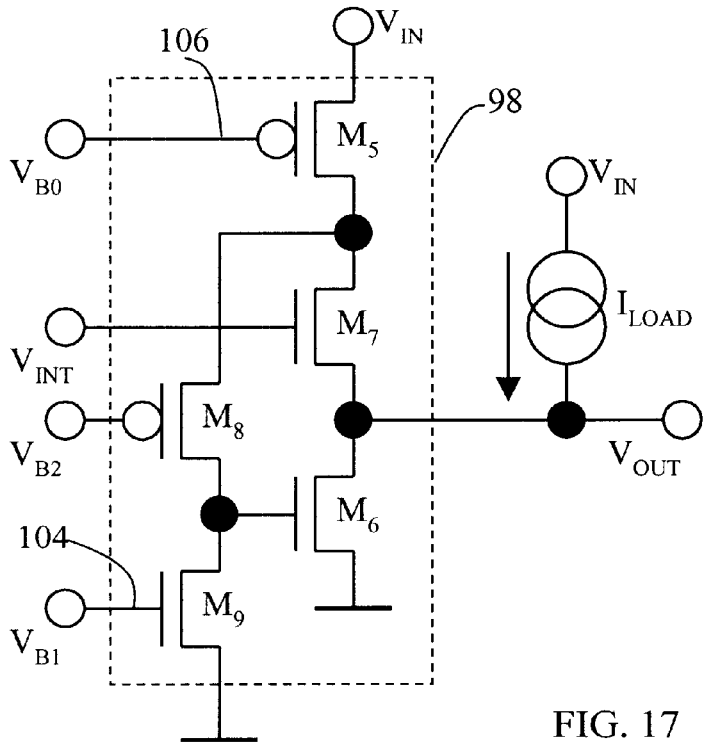

FIG. 17 shows an example of the output stage 98 (FIG. 15) implemented by using a PMOS transistor $M_5$ to function as the current source $I_0$, and an NMOS transistor $M_9$ as the current source $I_1$. Gate 104 of transistor $M_9$ is connected to a DC bias voltage $V_{B1}$, and gate 106 of transistor $M_5$ is connected to a bias voltage $V_{B0}$.

Figure 18:
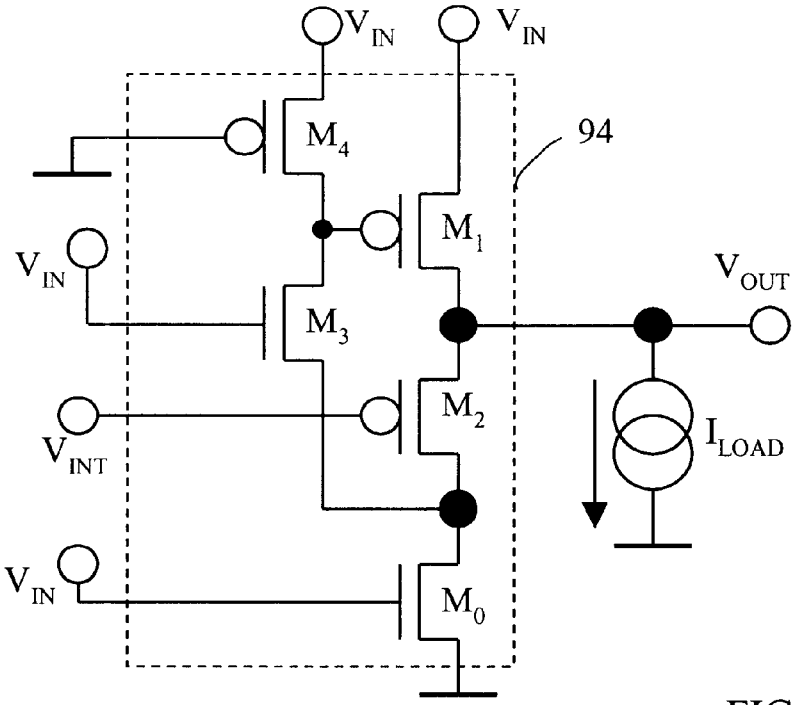

FIG. 18 shows an example of the output stage 94 (FIG. 16) where bias voltage $V_{B1}$ is identical to electric ground, and bias voltages $VB_2$ and $V_{B0}$ are identical to $V_{IN}$. Connecting the bias voltages to either $V_{IN}$ or ground reduces the implementation complexity because no additional biasing circuits are required.

Figure 19:
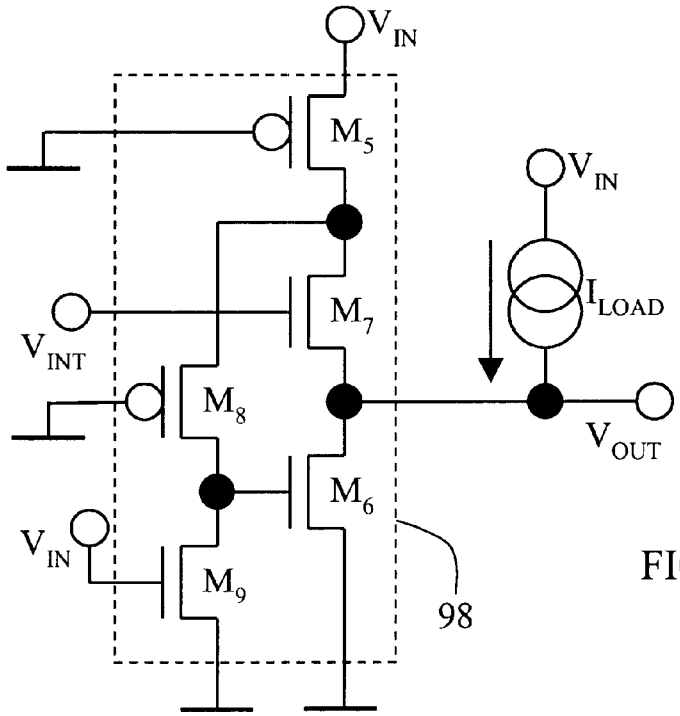

FIG. 19 shows an example of the output stage 98 (FIG. 17) where bias voltages $V_{B0}$ and $V_{B2}$ are identical to ground, and $V_{B1}$ is identical to $V_{IN}$.

The low impedance output stage circuits in FIGS. 12, 14, 16, and 18 utilize PMOS transistors $M_1$ and $M_2$ to drive the output. They are suitable for applications where $V_{OUT} \geqq V_{IN}/2$ and where the output stage supplies current to the load circuit. The low impedance output stage circuits in FIGS. 13, 15, 17, and 19 utilize NMOS transistors $M_6$ and $M_7$ to drive the output. They are suitable for applications where $V_{OUT} \leqq V_{IN}/2$, such as for body bias generation for NMOS devices and where the output stage sinks current from the load circuit.

The output stage circuits may be adapted to different applications by modifying the sizes of the MOSFET devices. For applications where $I_{LOAD}$ is unipolar (i.e., the load current only flows in one direction), the quiescent current $I_0$ of the output stage circuits may be smaller than the output current $I_{LOAD}$(e.g., $I_0$ may be 5% of $I_{LOAD}$). Faster response may be achieved by increasing the quiescent current $I_0$. For applications where push-pull operation is required and $I_{LOAD}$ is bipolar (e.g., AC decoupling of a bias voltage), the quiescent current $I_0$ may be approximately equal to the peak AC current.

An advantage of the output stage circuits 94 and 98 is that they do not require decoupling capacitors for feedback stability. For very fast load current variations, it may be necessary to connect decoupling capacitors to the output node to suppress the first droop or rise in the output voltage.

Series Voltage Regulator with Output Stage Having Fast Internal Feedback

Figure 20:
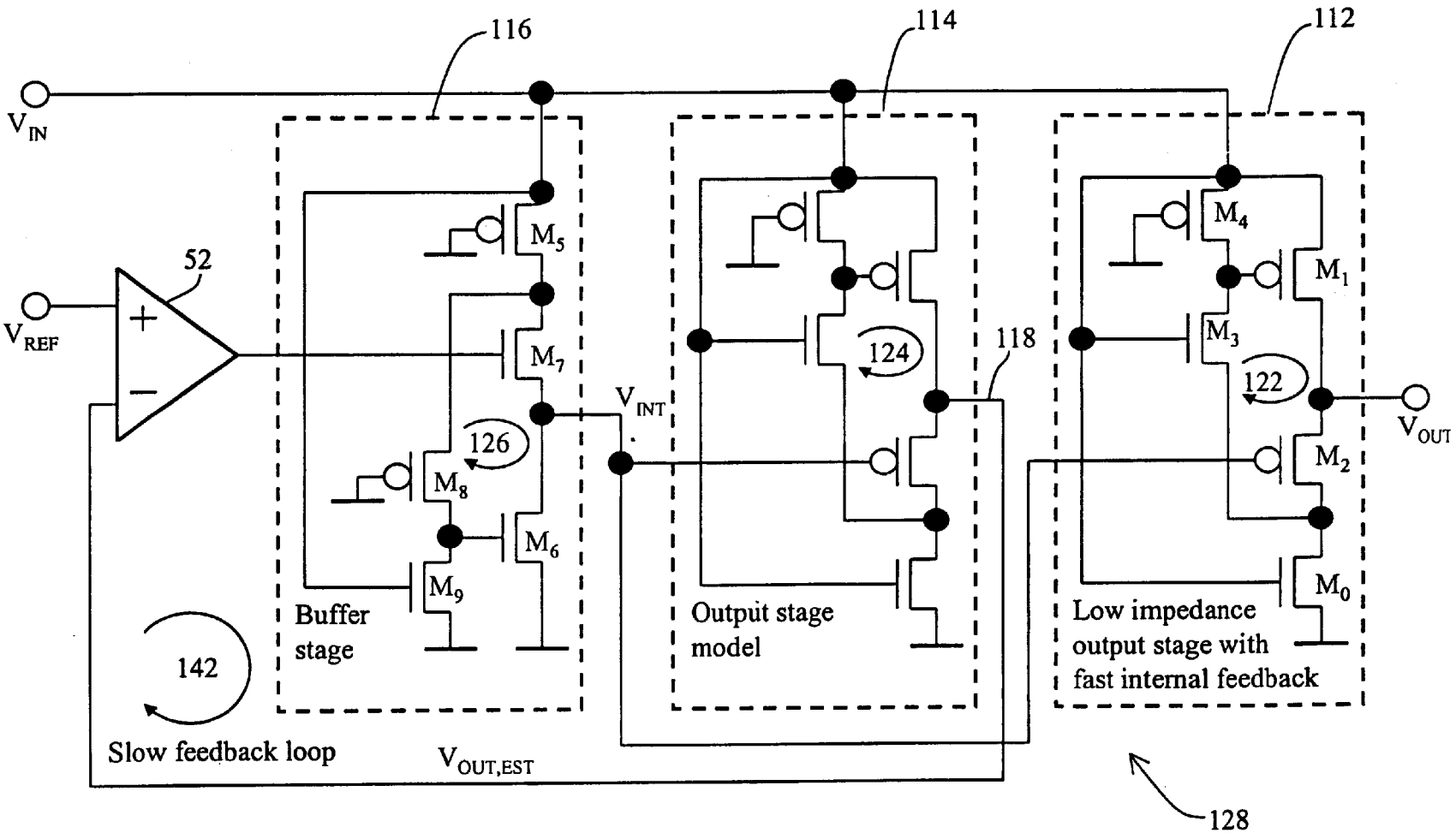
FIGS. 20 and 21 show series voltage regulators.

The following paragraphs describe how the output stage circuits in FIGS. 18 and 19 may be utilized in the series voltage regulator in FIG. 9. FIG. 20 shows an example of a series voltage regulator 128 that includes a differential amplifier 52, a low impedance output stage 112, an output stage model 114, and a buffer stage 116. The output stage 112 has a configuration similar to the output stage 94 (FIG. 18). The output stage model 114 is a scaled down version of the output stage 112. The buffer stage 116 has a configuration similar to the output stage 98 (FIG. 19). The output stage model 114 generates an output at node 118, which is connected to the negative input of amplifier 52, forming a feedback loop 142. In feedback loop 142, the differential amplifier 52 only tracks "zero-load errors" caused by manufacturing process, operating temperature, and power supply variations. The zero load errors represent deviations of the output voltage when there is no load. The feedback loop 142 may be designed to have low bandwidth and high DC gain.

The load current changes are tracked by an internal high-speed feedback loop 122 of the output stage 112. In addition, the output stage model 114 has a fast internal feedback loop 124, and the buffer stage 116 has a fast internal feedback loop 126. The internal feedback loops 122, 124, 126 may be designed to have high-bandwidth, allowing regulator 128 to have low output impedance and fast response to load current changes.

The series voltage regulator 128 is suitable for applications where $V_{IN}/2 \leqq V_{OUT} < V_{IN}$. Regulator 128 uses a fast PMOS low-impedance output stage 112 for generating $V_{OUT}$, and a fast low-impedance NMOS stage 116 to buffer $V_{INT}$. The transistors in the buffer stage 116 may be sized for efficient push-pull operation to suppress AC noise on $V_{INT}$ coupled through gate capacitance of transistor $M_2$ in the output stage 112. For applications where only positive output current is required, transistors in the output stage 112 may be sized to achieve rapid pull-up of the output node.

Figure 21:
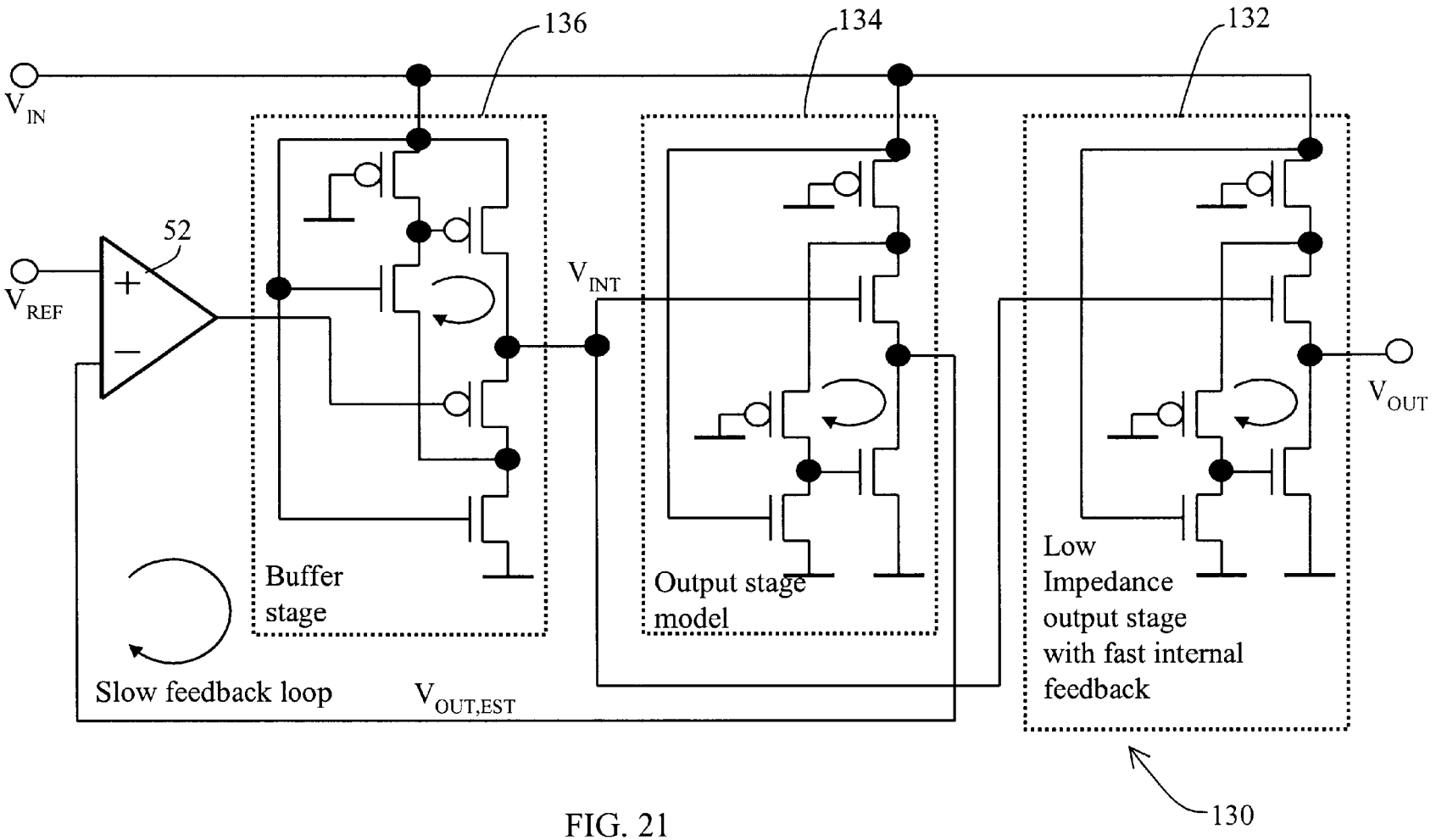

FIG. 21 shows an example of a series voltage regulator 130 that is suitable for applications where $0 < V_{OUT} \leqq V_{IN}/2$. Regulator 130 is a complementary circuit of regulator 128 (FIG. 20). Regulator 130 includes a differential amplifier 52, a low impedance output stage 132, an output stage model 134, and a buffer stage 136. The output stage 132 has a configuration similar to the output stage 98 (FIG. 19). The output stage model 134 is a scaled down version of the output stage 132. The buffer stage 136 has a configuration similar to the output stage 94 (FIG. 18). Regulator 130 contains feedback loops that operate in a manner similar to those contained in regulator 128.

Integrated Circuit Having Series Voltage Regulator

Figure 22:
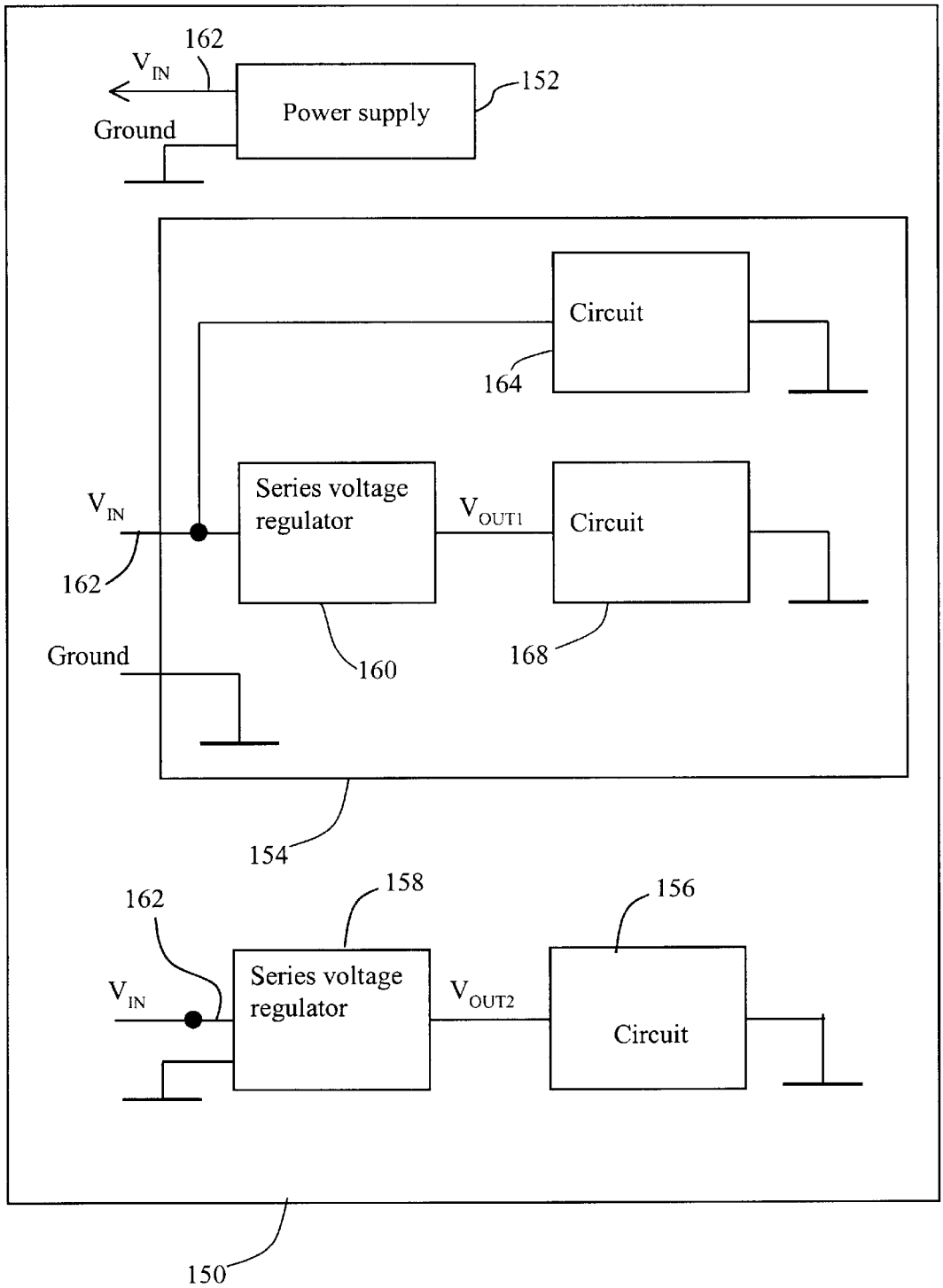
FIG. 22 shows an integrated circuit chip.

FIG. 22 shows a circuit board 150 that includes a power supply 152 and two integrated circuit (IC) chips 154 and 156. Power supply 152 generates a supply voltage $V_{IN}$ on line 162. IC chip 154 includes a series voltage regulator 160 that receives $V_{IN}$ and generates a supply voltage $V_{OUT1}$ that is lower than $V_{IN}$. Chip 154 includes a circuit 164 that uses voltage $V_{IN}$ as the supply voltage, and a circuit 168 that uses voltage $V_{OUT1}$ as the supply voltage. Circuit board 150 includes a series voltage regulator 158 that is manufactured as an independent IC chip. Regulator 158 receives $V_{IN}$ and generates supply voltage $V_{OUT2}$ used by IC chip 156. By using supply voltages $V_{OUT1}$ and $V_{OUT2}$ that are lower than $V_{IN}$,circuit 168 and IC chip 156 may consume less power than if $V_{IN}$ were used as the supply voltage.

In the example shown in FIG. 22, series voltage regulator 160 may be manufactured on the same die as circuit 168. In another example, regulator 160 and circuit 168 may be manufactured on different dies but packaged in the same package. In yet another example, there may be more than one series voltage regulators generating various supply voltages in the same chip. In yet another example, the series regulator may span a number of chips, e.g., one chip may contain transistor $M_1$ (FIG. 20) that dissipates a higher power, while another chip may include the remaining transistors (which dissipate low power). The transistor $M_1$ may also be a discrete transistor.

Although some implementations have been described above, other embodiments are also within the scope of the following claims.

For example, a cascaded current source may be utilized for $I_0$, $I_1$, or both, in order to achieve higher loop gain, especially in applications where input voltage $V_{IN}$ is low. The chip 154 may include digital circuits and/or analog circuits. The board 150 may be used in various systems, such as computer systems and telecommunications systems. The voltage regulators may be implemented using bipolar junction transistors. The voltage regulators may also be made by a BiCMOS process. The reference voltage $V_{REF}$ may be generated using any type of constant voltage source.

What is claimed is:

1. A method comprising controlling an output voltage to track a first reference voltage by using a feedback loop to control a current delivered to or received from a load to tend to maintain the output voltage substantially constant relative to a second reference voltage, and controlling the second reference voltage to cause the output voltage to track the first reference voltage.

2. The method of claim 1 in which controlling the second reference voltage comprises using a second feedback loop to control the second reference voltage based on a difference between the output voltage and the first reference voltage.

3. The method of claim 2 in which using the second feedback loop comprises using a differential amplifier to amplify a difference between the output voltage and the first reference voltage.

4. The method of claim 1 in which using the feedback loop comprises using a driving transistor, a level shifter, and a gain stage to control the current.

5. The method of claim 1, further comprising providing a supply voltage to a second load, the supply voltage having a voltage level different from the first reference voltage, and generating the output voltage from the supply voltage.

6. A method comprising controlling an output voltage to track a first reference voltage by using a feedback loop to control a current delivered to or received from a load to tend to maintain the output voltage substantially constant relative to a second reference voltage, using a model of the feedback loop to generate an estimated output voltage that estimates the output voltage when the feedback loop delivers to or receives from the load a predetermined current, and controlling the second reference voltage to cause the estimated output voltage to track the first reference voltage.

7. The method of claim 6 in which using the model comprises using a scaled replica of the feedback loop to generate the estimated output voltage.

8. The method of claim 6 in which controlling the second reference voltage comprises using an amplifier to generate the second reference voltage based on a difference between the estimated output voltage and the first reference voltage.

9. The method of claim 6, further comprising providing a supply voltage to a second load, the supply voltage having a voltage level different from the first reference voltage, and generating the output voltage from the supply voltage.

10. An apparatus comprising a feedback loop connected to control a current delivered to or received from a load to maintain an output voltage substantially constant relative to a first reference voltage; and a circuit connected to control the first reference voltage to cause the output voltage to track a second reference voltage.

11. The apparatus of claim 10 in which the feedback loop comprises a driving transistor, a gain stage, and a level shifter.

12. The apparatus of claim 10 in which the feedback loop comprises a first transistor and a second transistor, the first and second transistors being P-type transistors and each having a drain, a source, and a gate, the drain of the first transistor being coupled to the source of the second transistor, the drain of the first transistor generating the output voltage, the gate of the second transistor being coupled to the first reference voltage, the drain of the second transistor being coupled to the gate of the first transistor.

13. The apparatus of claim 12 further comprising a third transistor coupled between the drain of the second transistor and the gate of the first transistor, the third transistor being an N-type transistor having a drain, a source, and a gate, the drain of the third transistor being coupled to the gate of the first transistor, the source of the third transistor being coupled to the drain of the second transistor, and the gate of the third transistor being coupled to a bias voltage.

14. The apparatus of claim 13 further comprising a first current source coupled to the drain of the second transistor and a second current source coupled to the drain of the third transistor.

15. The apparatus of claim 10 in which the circuit comprises an amplifier to amplify a difference between the output voltage and the first reference voltage.

16. The apparatus of claim 10 in which the feedback loop comprises a first transistor and a second transistor, the first and second transistors being N-type transistors each having a drain, a source, and a gate, the source of the first transistor being coupled to the drain of the second transistor, the drain of the second transistor generating the output voltage, the gate of the first transistor being coupled to the first reference voltage, the drain of the first transistor being coupled to the gate of the second transistor.

17. The apparatus of claim 16 further comprising a third transistor coupled between the drain of the first transistor and the gate of the second transistor, the third transistor being a P-type transistor having a drain, a source, and a gate, the drain of the third transistor being coupled to the gate of the second transistor, the source of the third transistor being coupled to the drain of the first transistor, and the gate of the third transistor being coupled to a bias voltage.

18. The apparatus of claim 17 further comprising a first current source coupled to the drain of the first transistor and a second current source coupled to the drain of the third transistor.

19. The apparatus of claim 10 further comprising a buffer stage coupled between the feedback loop and the circuit.

20. An apparatus comprising a feedback loop connected to control a current delivered to or received from a load to maintain an output voltage substantially constant relative to a first reference voltage;

a first circuit connected to generate an estimated output voltage based on the first reference voltage, the estimated output voltage estimating the output voltage when the feedback loop delivers to or receives from the load a predetermined current; and a second circuit connected to adjust the first reference voltage to control the first circuit to cause the estimated output voltage to track a second reference voltage.

21. The apparatus of claim 20 in which the feedback loop comprises a driving transistor, a gain stage, and a level shifter.

22. The apparatus of claim 20 in which the first circuit is a scaled replica of the feedback loop.

23. The apparatus of claim 20 in which the second circuit and the first circuit form a second feedback loop having a larger loop delay than the loop delay of the feedback loop connected to control the current.

24. The apparatus of claim 20 in which the second circuit comprises an amplifier that generates the first reference voltage based on a difference between the estimated output voltage and the second reference voltage.

25. The apparatus of claim 20 in which the feedback loop comprises a first transistor, a second transistor, and a third transistor, the first, second, and third transistors each having a drain, a source, and a gate, the drain of the first transistor being coupled to the source of the second transistor, the drain of the first transistor generating the output voltage, the gate of the first transistor being coupled to the drain of the third transistor, the drain of the second transistor being coupled to the source of the third transistor, the gate of the second transistor being coupled to the first reference voltage, the gate of the third transistor being coupled to a bias voltage.

26. The apparatus of claim 20 in which the feedback loop comprises a first transistor, a second transistor, and a third transistor, the first, second, and third transistors each having a drain, a source, and a gate, the source of the first transistor being coupled to the drain of the second transistor, the source of the first transistor generating the output voltage, the gate of the first transistor being coupled to the first reference voltage, the drain of the first transistor being coupled to the source of the third transistor, the gate of the second transistor being coupled to the drain of the third transistor, the gate of the third transistor being coupled to a bias voltage.

27. The apparatus of claim 20, further comprising a buffer stage coupled between the first circuit and the second circuit.

28. An apparatus comprising:

a circuit board;

an integrated circuit chip having a first circuit designed to operate using a first supply voltage, a second circuit designed to operate using a second supply voltage, and a voltage regulator to generate the second supply voltage from the first supply voltage, the voltage regulator including a feedback loop connected to control a current delivered to or received from the second circuit to maintain the second supply voltage substantially constant relative to a first reference voltage, and a third circuit connected to control the first reference voltage to cause the second supply voltage to track a second reference voltage.

29. The apparatus of claim 28, further comprising a band-gap reference circuit to generate the second reference voltage.

30. The apparatus of claim 28, further comprising a power supply to generate the first supply voltage.

31. An apparatus, comprising:

a first circuit designed to operate using a first supply voltage;

a second circuit designed to operate using a second supply voltage; and a voltage regulator to generate the second supply voltage from the first supply voltage, the voltage regulator including a feedback loop connected to control a current delivered to or received from a load to maintain the second supply voltage substantially constant relative to a first reference voltage, a third circuit connected to generate an estimated second supply voltage based on the first reference voltage, the estimated second supply voltage estimating the second supply voltage when the feedback loop delivers to or receives from the load a predetermined current; and a fourth circuit connected to adjust the first reference voltage to control the third circuit to cause the estimated second supply voltage to track a second reference voltage.

32. The apparatus of claim 31 in which the first circuit comprises a data processor.

33. The apparatus of claim 31 in which the second circuit comprises a memory.

* * * * *